US010184698B2

(12) United States Patent
Wang et al.

(10) Patent No.: US 10,184,698 B2
(45) Date of Patent: Jan. 22, 2019

(54) OVERLAPPING TYPE FREEZING-FORCE CIRCULATION REFRIGERATION UNIT

(71) Applicant: NANJING RECLAIMER ENVIRONMENTAL TEKNIK CO., LTD, Nanjing, Jiangsu (CN)

(72) Inventors: Haibo Wang, Jiangsu (CN); Laikou Liu, Jiangsu (CN); Bin Liang, Jiangsu (CN); Lin Ding, Jiangsu (CN)

(73) Assignee: NANJING RECLAIMER ENVIRONMENTAL TEKNIK CO., LTD, Nanjing, Jiangsu (CN)

( * ) Notice: Subject to any disclaimer, the term of this patent is extended or adjusted under 35 U.S.C. 154(b) by 613 days.

(21) Appl. No.: 14/785,118

(22) PCT Filed: Jan. 26, 2014

(86) PCT No.: PCT/CN2014/071468
§ 371 (c)(1),
(2) Date: Oct. 16, 2015

(87) PCT Pub. No.: WO2014/169723
PCT Pub. Date: Oct. 23, 2014

(65) Prior Publication Data

US 2016/0084543 A1 Mar. 24, 2016

(30) Foreign Application Priority Data

Apr. 18, 2013 (CN) ..... 2013 1 0137127

(51) Int. Cl.
*F25B 23/00* (2006.01)
*F01K 13/00* (2006.01)
(Continued)

(52) U.S. Cl.
CPC ..... *F25B 23/00* (2013.01); *F01K 13/00* (2013.01); *F01K 25/08* (2013.01); *F25B 23/006* (2013.01);
(Continued)

(58) Field of Classification Search
CPC .... F25B 23/00; F25B 23/006; F25B 2400/14; F25B 7/00; F25B 2400/05;
(Continued)

(56) References Cited

U.S. PATENT DOCUMENTS 3,415,077 A 12/1968 Collins

FOREIGN PATENT DOCUMENTS

CN 2856871 Y 1/2007
CN 103256743 A 8/2013
(Continued)

*Primary Examiner* — Orlando E Aviles
(74) *Attorney, Agent, or Firm* — Novick, Kim & Lee, PLLC; Allen Xue

(57) ABSTRACT

A cascade cold dynamic cycle refrigeration apparatus makes up cold energy with a cryogenic liquid refrigerant by boosting with a dual-stage liquid circulating pump. The temperature of the refrigerant is increased via the cold regenerator before it enters the cold consuming apparatus to provide cold and becomes a gaseous refrigerant. The gaseous refrigerant then flows through the expander to expand and generates work by reducing pressure and temperature. The gaseous refrigerant is condensed and returns to the refrigerant tank via the cold regenerator or/and a throttle valve.

7 Claims, 1 Drawing Sheet

(51) Int. Cl.

| | |
|---|---|
| ***F01K 25/08*** | (2006.01) |
| *F25B 11/02* | (2006.01) |
| *F01K 27/00* | (2006.01) |

(52) U.S. Cl.
CPC ..... *F01K 27/00* (2013.01); *F25B 11/02* (2013.01); *F25B 2400/14* (2013.01)

(58) Field of Classification Search
CPC ..... F25B 2400/051; F25B 2400/053; F25B 11/02; F01K 13/00; F01K 27/00
See application file for complete search history.

(56) References Cited

FOREIGN PATENT DOCUMENTS

| | | |
|---|---|---|
| CN | 203298518 U | 11/2013 |
| CN | 203298519 U | 11/2013 |

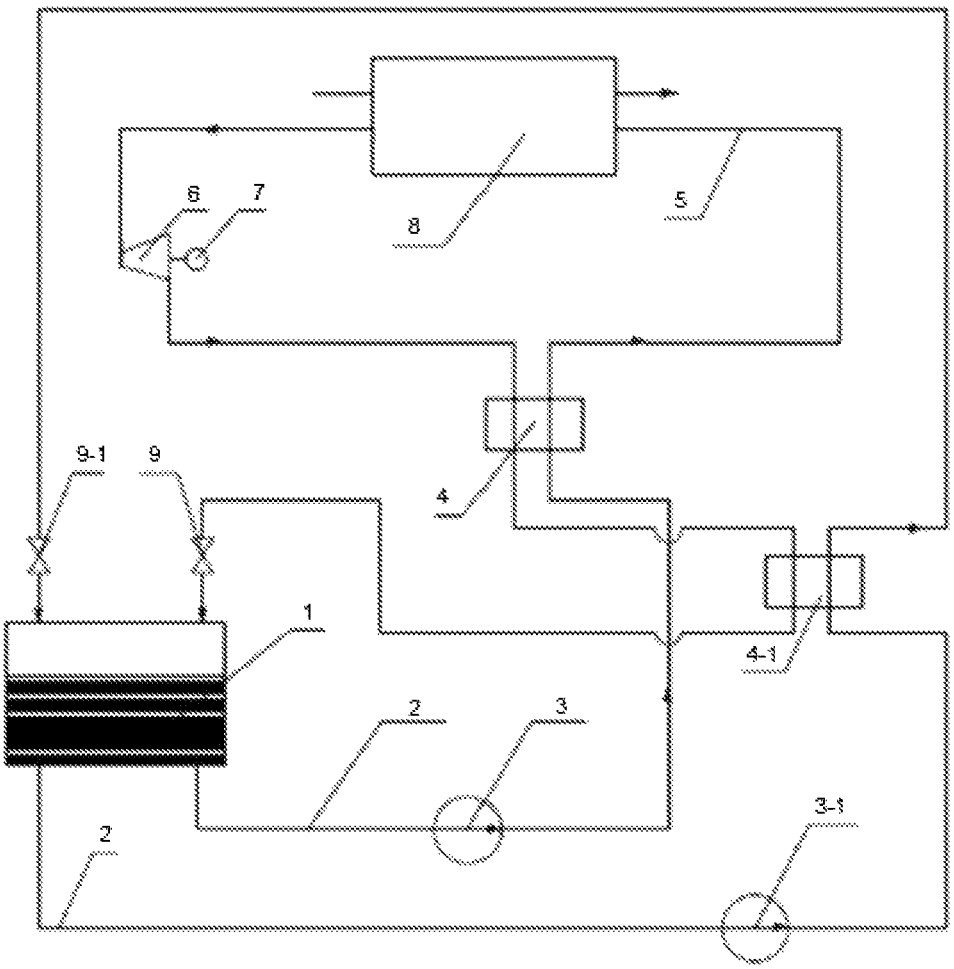
6
7
8
5
9-1
9
4
1
4-1
2
3
3-1
2

OVERLAPPING TYPE FREEZING-FORCE CIRCULATION REFRIGERATION UNIT

TECHNICAL FIELD

This invention falls into the refrigerating technology field, specifically it is about a cascade cold dynamic cycle refrigeration apparatus.

BACKGROUND OF THE INVENTION

Modern refrigeration technology, as a science, was developed in the mid and late 19th century, before that, tracing back to the ancestors of the human being, people learned very long ago to make use of cold and make simple manual refrigeration, and using cellars and cold store and cooling a store room with spring water have a history of 5000 years.

The 20th century saw greater development of refrigeration technologies: the household refrigerator was born in 1910, and was marketed as a commodity in the United States in 1917. In 1930, the appearance of Freon refrigerating media and the use of Freon refrigerators brought new transformation to the refrigeration technologies. In the 1970s, massive researches were conducted on mixed media, and co-boiling mixed media were used, ushering a new road for the development of steam compression refrigerators. Refrigeration technologies have developed today from food preservation and temperature conditioning in given spaces to all sectors of national economy, becoming more closely linked with the daily life of people.

1. Commerce

Main applications of refrigeration technologies are cold processing, storage and transport of perishable food (such as fish, meat, eggs, fruits and vegetables), to reduce food loss in production and distribution and ensure balanced marketing over all seasons.

In the modern food industry, a complete cold chain has been formed from food production, storage, transport and sales. Refrigeration apparatuses used include refrigerating warehouses, refrigerating vehicles, refrigerating vessels and refrigerating trains. In addition, refrigerating cabinets for commodities, various cold beverage equipment and commodity display cabinets with refrigerating equipment are used in food retail shops, canteens and restaurants.

2. Cooling and Air Conditioning

They include air conditioners for comfort in life, installed in hotels, theaters, metros, big public buildings, vehicles, aircraft cabins and offices. Air conditioning equipment in residents and so on provide a comfortable living and working environment for people, not only good to physical and psychological health, but also increasing production and working efficiency.

3. Industrial Production

In machine building, cryogenic treatment of steel (−70° C.--90° C.) can change its metallographic structure, turn the Austenite into Martensite and increase the hardness and strength of steel, and in machine assembling, low temperature can be used to realize interference fit easily. In the chemical industry, refrigeration can help gas liquefaction and separate mixed gases, and carry away reaction heat in chemical reactions. Refrigeration is required in salt crystallization, lubricating oil degreasing, petroleum cracking, rubber and resin synthesizing, fuel and fertilizer production, and also in the liquefaction, storage and transport of natural gas. In iron and steel industry, air is first dehumidified by refrigeration before being blown into a blast furnace, to reduce coking ratio and ensure the quality of molten iron, normally, a big blast furnace needs cold quantity of several megawatts.

4. Agriculture and Animal Husbandry

Refrigeration is used for cryogenic processing of crop seeds, creating artificial climatron for seedling cultivation, and reserving seminal fluid of fine breeds for artificial breed mating.

5. Project Construction

Refrigeration can be used to realize frozen excavation. In digging mines and tunnels and building river dams, or in tunneling in swamp and stratum with sand and water, frozen earth process can be used to prevent collapse in working area and ensure construction safety. In concrete batching, ice can be used in place of water, to compensate for the cement solidifying reaction heat by the heat absorbed by melting ice, to build big single-column concrete members, and this can effectively avoid internal stress, cracks and other defects in large structural members due to insufficient heat dissipation.

6. National Defense Industry

For engines, vehicles, tanks, artilleries and other conventional weapons to be used in high and cold areas, environmental simulation test should be done on their performance; for control instruments in aircrafts, rockets and missiles, performance test is required by simulating the cryogenic conditions at high altitude on ground, and all these require refrigeration to provide the environmental conditions for tests. Refrigeration is also required in the control of atomic energy reactors.

7. Medical Service and Public Health

Refrigeration is required in cryosurgery, such as operation on heart, excision of tumor, cataract and tonsil, skin and eyeball transplanting and hypothermic anesthesia. In addition to storage of vaccines and drugs at low temperature, blood and skim are also stored with freezing vacuum drying method.

Furthermore, refrigerating technology also has important applications in cutting-edge sciences such as micro-electronic technology, energy, new type raw materials, exploitation of space and biological technology.

In summary, refrigerating methods can be classified into two categories: those by inputting work and those by inputting heat. Vapor compression refrigeration and thermoelectric refrigeration belong to the former, and absorption refrigeration, vapor jetting refrigeration, and adsorption refrigeration belong to the latter.

Researches on traditional refrigerating technologies can be summarized as the following three aspects:

1) Researches on methods to obtain low temperature, the relevant mechanisms and the corresponding refrigerating cycles, and thermodynamic analysis and calculation of refrigerating cycles.

2) Researches on the properties of refrigerants, to provide refrigerators with media having satisfactory performance. Mechanical refrigeration can be realized by changing the thermodynamic status of refrigerant, therefore, the thermal physical property of refrigerant is the basis for cycle analysis and calculation. Furthermore, for the practical application of refrigerants, their general physical and chemical properties must also be well known.

3) Researches on the machinery and technical equipment required to realize refrigerating cycles, their working principles, performance analysis, structural design and calculation, and the flow organization and system associated calculation for various refrigeration apparatuses. In addition, there are questions about thermal insulation and automation of refrigerating equipment and so on.

The first two aspects mentioned above constitute the theoretical foundation of refrigeration, i.e. the researches on traditional refrigerating principles, and the third aspects is about the specific machines, equipment and apparatus.

The traditional refrigerating theory is mainly based on thermodynamics, i.e. Carnot reverse cycle of identical temperature difference is used to analyze the refrigerating cycle process, the economic indicator of the refrigerating cycle is the refrigeration coefficient, or the ratio of obtained gain to the cost of consumption, and also, of all refrigerating cycles between atmospheric environment with temperature of $T_0$ and low temperature heat source with temperature of Tc (such as refrigeration store), the reverse Carnot cycle has the highest refrigeration coefficient:

$$\varepsilon_c = (COP)_{R,C} = \frac{q_2}{w_0} = \frac{T_c}{T_0 - T_c} \tag{1}$$

In the formula above, $\varepsilon_c$ is the refrigeration coefficient, $q_2$ refrigerating capacity of the cycle, and $w_0$ the net work consumed by the cycle.

In fact, in his thesis "Reflections on the Motive Power of Heat", Carnot concluded that: of all heat engines working between two constant temperature heat sources of different temperatures, the reversible heat engine has the highest efficiency." This was later referred to as the Carnot theorem, after rearranging with the ideal gas state equation, the thermal efficiency of Carnot cycle obtained is:

$$\eta_c = 1 - \frac{T_2}{T_1} \tag{2}$$

In Formula (2), temperature $T_1$ of the high temperature heat source and temperature $T_2$ of low temperature heat source are both higher than the atmosphere ambient temperature $T_0$, and the following important conclusions can be obtained:

1) The thermal efficiency of Carnot cycle only depends on the temperature of high temperature heat source and low temperature heat source, or the temperature at which the media absorbs heat and release heat, therefore the thermal efficiency can be increased by increasing $T_1$ and decreasing $T_2$.

2) The thermal efficiency of Carnot cycle can only be less than 1, and can never be equal to 1, because it is not possible to realize $T_1=\infty$ or $T_2=0$. This means that a cyclic engine, even under an ideal condition, cannot convert all thermal energy into mechanical energy, of course, it is even less possible that the thermal efficiency is greater than 1.

3) When $T_1=T_2$, the thermal efficiency of the cycle is equal to 0, it indicates that in a system of balanced temperature, it is not possible to convert heat energy into mechanical energy, heat energy can produce power only with a certain temperature difference as a thermodynamic condition, therefore it has verified that it is not possible to build a machine to make continuous power with a single heat source, or the perpetual motion machine of the second kind does not exist.

4) Carnot cycle and its thermal efficiency formula are of important significance in the development of thermodynamics. First, it laid the theoretical foundation for the second law of thermodynamics; secondly, the research of Carnot cycle made clear the direction to raise the efficiency of various heat power engines, i.e. increasing the heat absorbing temperature of media and lowering the heat release temperature of media as much as possible, so that the heat is release at the lowest temperature that can be naturally obtained, or at the atmospheric temperature. The method to increase the gas heat absorbing temperature by adiabatic compression is still a general practice in heat engines with gas as media today.

5) The limit point of Carnot cycle is atmospheric ambient temperature, and for refrigerating process cycles below ambient temperature, Carnot cycle has provided no definite answer.

Because of the incompleteness of refrigeration coefficient, many scholars at home and abroad conducted research on it, and proposed methods to further improve it. In "Research on Energy Efficiency Standard of Refrigerating and Heat Pump Products and Analysis of Consummating Degree of Cyclic Thermodynamics", Ma Yitai et al, in conjunction with the analysis of introduction of the irreversible process of heat transfer with temperature difference into heat cycle by Curzon and Ahlborn and the enlightenment from the finite time thermodynamics created on it, as well as the CA cycle efficiency, proposed the consummating degree of thermodynamics, advancing to a certain extent the energy efficiency research on the refrigerating and heat pump products.

However, the basic theory of thermodynamics cannot make simple, clear and intuitional explanation of the refrigerating cycle. Einstein commented the classical thermodynamics this way: "A theory will give deeper impression to the people with simpler prerequisite, more involvement and wider scope of application." In the theoretical interpretation in the refrigeration field, this point should be inherited and carried forward.

Therefore, it has become a difficult issue in the research of refrigeration technical field to really find the theoretical foundation for the refrigerating cycle, develop new refrigerating cycle apparatus on this theoretical foundation and apply them in practice, and effectively reduce the energy consumption.

Content of the Invention

The purpose of this invention is, for improving the completeness of applying Carnot theorem to refrigeration apparatus and analysis of refrigerating cycle theory, proposing a new refrigerating theory corresponding to thermodynamic theory, or cold dynamics theory: any environment below the atmospheric ambient temperature is referred to as a cold source, corresponding to heat source above the ambient temperature; and corresponding to heat energy and heat, the corresponding concepts of cold energy and cold are proposed; The said refrigeration apparatus refers to that consuming mechanical power to realize transfer of cold energy from atmospheric environment to cold source of low temperature or from a cold source of low temperature to that of lower temperature. In the transfer of cold energy, some substance is required as working media in the refrigeration apparatus, and it is referred to as refrigerating media. The said refrigerating media, refers to a single-component low boiling point refrigerating media with boiling point below −10° C. under standard state, or a mixed refrigerating media with the refrigerating media with boiling point below −10° C. under standard state as the main.

In the refrigerating process, the transfer of cold energy follows the energy conversion and conservation law.

To describe the cold transfer direction, conditions and limit in the refrigerating process, the second law of cold dynamics is proposed: the essence of the second law of cold dynamics is identical to that of the second law of thermodynamics, and it also follows the "energy quality declining principle", i.e. cold energy of different forms differs in "quality" in the ability to convert into power; and even the cold energy of the same form also has different ability of conversion at different status of existence. All actual processes of cold energy transfer are always in the direction of energy quality declination, and all cold energy spontaneously converts in the direction of atmospheric environment. The process to increase the quality of cold energy cannot perform automatically and independently, a process to increase energy quality is surely accompanied by another process of energy quality declination, and this energy quality declination process is the necessary compensating condition to realize the process to increase energy quality, that is, the process to increase energy quality is realized at the cost of energy quality declination as compensation. In the actual process, the energy quality declination process, as a cost, must be sufficient to compensate for the process to increase the energy quality, so as to meet the general law that the total energy quality must certainly decline. Therefore, with the given compensation condition for energy quality declination, the process to increase the energy quality surely has a highest theoretical limit. This theoretical limit can be reached only under the complete reversible ideal condition, in this case, the energy quality increase value is just equal to the compensation value for energy quality declination, so that the total energy quality remains unchanged. This shows that a reversible process is a pure and ideal process of energy quality conservation, in an irreversible process, the total energy quality must surely decline, and in no case it is possible to realize a process to increase the total energy quality in an isolated system. This is the physical connotation of the energy quality declining principle, the essence of the second law of cold dynamics, and also the essence of the second law of thermodynamics, and it reveals the objective law of the direction, conditions and limit of process that must be followed by all macroscopic processes.

The basic formula describing the second law of cold dynamics is:

$$\eta_c = 1 - \frac{T_{c2}}{T_{c1}} \tag{3}$$

In Formula (3), $Tc2<Tc1<T_0$, $T_0$ is the ambient temperature, all based on Kelvin temperature scale.

With respect to the ambient temperature $T_0$, the maximum cold efficiency of the cold source at Tc1 and Tc2 is:

$$\eta_c = 1 - \frac{T_{c1}}{T_0} \tag{4}$$

$$\eta_c = 1 - \frac{T_{c2}}{T_0} \tag{5}$$

Suppose $q_2$ is the refrigerating capacity of the cycle, and $w_0$ the net power consumed by the cycle, then when the cold source temperature is Tc1:

$$w_0 = \left(1 - \frac{T_{c1}}{T_0}\right)q_2 \tag{6}$$

Similarly, when the cold source temperature is Tc2:

$$w_0 = \left(1 - \frac{T_{c2}}{T_0}\right)q_2 \tag{7}$$

It is not difficult to see from Formulas (4) to (7) that, the efficiency of the cold dynamics is between 0 and 1, and due to unavoidable irreversibility in the actual process, the refrigerating cycle efficiency is less than 1; when the ambient temperature $T_0$ is determined, the lower cold source temperature, the more refrigerating capacity can be obtained with the same amount of work input, and this has pointed out the direction for building a new refrigerating cycle.

It should be noted that:

(1) The cold is transferred spontaneously from the cryogenic cold source to ambient temperature;

(2) It is not possible to transfer cold from a cryogenic cold source to a cold source of lower temperature without causing other change;

(3) When the cold is transferred from a cryogenic cold source to the environment, the power exchanged with the outside is $w_0$, which includes the useless work $p_0(V_0-V_c)$ made to the environment, $p_0$ is the atmospheric pressure, $V_0$ the volume at ambient temperature, $V_c$ the volume at cold source temperature, and the maximum reversible useful work made is:

$$(W_u)_{max} = W_0 - p_0(V_0 - V_c) = \left(1 - \frac{Tc}{To}\right)Q_0 - p_0(V_0 - V_c)$$

(4) When the cold is transferred from a cryogenic cold source to the environment, the useless energy transferred to the environment is:

$$E_{useless} = \frac{Tc}{To}Q_0$$

The useless work transferred to the environment is: $p_0(V_0-V_c)$

Corresponding to the useful energy "Yong" and useless energy "Jin" of heat quantity, and with the meanings of heat for fire and cold for water, the useful energy of cold energy is named as "cold energy lian", and the useless energy of cold energy transferred to the environment is named as "cold energy jin", and this "jin" is to water.

(5) When cold energy is transferred to environment, the best form of making work to the outside is using a thermoelectric generator of Seebeck effect, generator, or cold power generator;

(6) In cold dynamics, the energy must and also inevitably follow the energy conversion and conservation law;

(7) With reference to the conception of finite time thermodynamics, it is possible to develop the basic theory of finite time cold dynamics;

(8) The quality of cold energy cannot be assessed by separating it from the specific environment;

(9) Cold dynamics and thermodynamics are two branches of the energetics, and are a unity of opposites: in a cryogenic refrigerating cycle, while following the second law of cold dynamics, the cycle process of refrigerant media formed in the cryogenic environment also follows the Rankine cycle, so it comes back to the Carnot law, just in line with the principle of the Chinese traditional aesthetics that yin and yang mutually complement.

It can be seen from the theoretical foundation above that, the supposed cold dynamics has a theoretical framework system symmetric to thermodynamics, so it complies with the basic principle of scientific aesthetics, or the principle of opposite and complementary symmetricity.

On the basis of the afore-said basic principle of cold dynamics, this invention has built a cascade cold dynamic cycle refrigeration apparatus different from traditional ones.

The technical scheme adopted by this invention is as follows, A cascade cold dynamic cycle refrigeration apparatus, with the features that:

The liquid refrigerant 2 from refrigerant tank 1, after being boosted via liquid circulating pump 3, flows via cold regenerator 4, cold consuming apparatus 8, and expander 6 to drive the braking equipment 7, the exhaust vapor from expander 6 flows again via cold regenerator 4, cold regenerator 4-1 and throttle valve 9, and returns to the refrigerant tank 1; the liquid refrigerant 2 from refrigerant tank 1, after being boosted by the liquid circulating pump 3-1, flows via the cold regenerator 4-1 and throttle valve 9-1, and returns to the refrigerant tank 1, so as to form the cascade cold dynamic cycle circuit of the refrigerating media.

The said refrigerating media 2 or refrigerant, refers to a single-component low boiling point refrigerating media with boiling point below −10° C. under standard state, or a mixed refrigerating media with the refrigerating media with boiling point below −10° C. under standard state as the main.

The said cascade cold dynamic cycle refrigeration apparatus is provided with throttle valves 9 and 9-1: the liquid refrigerant 2 from refrigerant tank 1, after being boosted via liquid circulating pump 3, flows via cold regenerator 4, cold consuming apparatus 8, and expander 6 to drive the braking equipment 7, the exhaust vapor from expander 6 flows again via cold regenerator 4, cold regenerator 4-1 and throttle valve 9, and returns to the refrigerant tank 1; the liquid refrigerant 2 from refrigerant tank 1, after being boosted by liquid circulating pump 3-1, flows via cold regenerator 4-1 and throttle valve 9-1, and returns to the refrigerant tank 1, so as to form the cascade cold dynamic cycle circuit of the refrigerating media.

The said cold consuming apparatus 8 includes without limitation cold consuming equipment such as refrigerator, air conditioner and refrigerating store.

The braking equipment 7 of the said expander 6 refers to fan, hydraulic pump, generator or gas compressor.

The said cold regenerator 4 and cold regenerator 4-1 are the so-called heat regenerator and heat exchanger in a traditional refrigerating cycle, in the form of tube-shell type cold exchanger, plate-fin cold exchanger, micro channel cold exchanger or other types of cold exchanger, their structure is identical or similar to that of tube-shell type heat exchanger, plate-fin heat exchanger, micro channel heat exchanger in a traditional refrigerating cycle.

The said refrigerant tank 1 shall be provided with thermal and cold insulation, such as thermal isolated vacuum container, and insulation materials such as pearlite.

The said cascade cold dynamic cycle refrigeration apparatus is also applicable to an open refrigerating system: i.e. the refrigerant with pressure and temperature reduced in expander 6 is supplied externally to other cold consuming apparatus, and the liquid refrigerant 2 of the same quality is made up to the refrigerant tank 1, so as to maintain the balance of the refrigerant.

The equipment and their backup systems, pipes, instruments, valves, cold insulation and bypass facilities with regulation functions not described in this invention shall be configured with mature technologies of generally known traditional refrigerating cycles.

The apparatus in this invention is also applicable to an open cold refrigerating system: i.e. the refrigerant with pressure and temperature reduced in expander 6 is supplied externally to cold consuming apparatus, and the liquid refrigerant 2 of the same quality and amount is made up to the refrigerant tank 1, so as to maintain balance of the refrigerant, which is comparable with the back pressure heat supply apparatus in a Rankine cycle of steam.

The equipment and their backup systems, pipes, instruments, valves, cold insulation and bypass facilities with regulation functions not described in this invention shall be configured with mature technologies of generally known traditional refrigerating cycles.

As compared with existing technologies, this invention has the following advantages: it has substantial energy conservation effect: the vapor compressor in the traditional refrigerating cycle is cancelled, by using the property of liquid as an almost incompressible fluid, the cryogenic liquid circulating pump is used to increase pressure and make up, in conjunction with the second law of cold dynamics, it can effectively increase the efficiency of refrigerating cycle, and compared with a traditional refrigeration apparatus, with the same refrigerating capacity, energy can be saved by over 30%. This invention requires no condenser and the associated cooling water system as in a traditional vapor compression refrigeration cycle, the process setup is simpler and better complies with the principle of energy conservation and environmental protection, the expander and cold regenerator can be sealed in the same apparatus, to reduce cold loss; equipment maintenance work quantity has been greatly reduced as compared with a traditional refrigerating cycle, the oil-free lubrication technology can be used with convenience, to eliminate the deterioration of lubricating oil in a traditional vapor compressor and its effect on the refrigerating cycle, so that the maintenance and operation cost can be reduced considerably; heat transfer can be enhanced, as compared with traditional refrigerating circulation technology, it can adopt enhanced cold transfer elements more conveniently, with more compact refrigerating equipment and higher refrigerating efficiency.

DESCRIPTION OF FIGURES

To facilitate understanding by technical personnel in the field, the invention is further described in the following in conjunction with figures.

FIG. 1 is a process schematic diagram of a cascade cold dynamic cycle refrigeration apparatus of this invention.

In FIG. 1: 1-refrigerant tank, 2-liquid refrigerant, 3-liquid circulating pump, 3-1-liquid circulating pump, 4-cold regenerator, 4-1-cold regenerator, 5-refrigerant, 6-expander, 7-braking equipment, 8-cold consuming apparatus, 9-throttle valve, 9-1-throttle valve.

EMBODIMENTS

To facilitate understanding by technical personnel in the field, the invention is further described in the following in conjunction with figures.

As shown in FIG. 1, a cold dynamic cycle refrigeration apparatus, with the specific embodiment as follows:

Liquid nitrogen is used as refrigerant.

The liquid refrigerant 2 from refrigerant tank 1, after being boosted via liquid circulating pump 3, flows via cold regenerator 4, cold consuming apparatus 8, and expander 6 to drive the braking equipment 7, the exhaust vapor from expander 6 flows again via cold regenerator 4, cold regenerator 4-1 and throttle valve 9, and returns to the refrigerant tank 1; the liquid refrigerant 2 from refrigerant tank 1, after being boosted by the liquid circulating pump 3-1, flows via the cold regenerator 4-1 and throttle valve 9-1, and returns to the refrigerant tank 1, so as to form the cascade cold dynamic cycle circuit of the refrigerating media.

The said cold consuming apparatus 8 is used as a refrigerating store.

The braking equipment 7 of the said expander 6 is a hydraulic pump, as a booster pump of liquid nitrogen.

The said cold regenerator 4 and cold regenerator 4-1 are plate-fin cold exchanger or micro channel cold exchanger.

The said refrigerant tank 1 is an insulated vacuum container, and pearlite is used as insulation materials.

The equipment and their backup systems, pipes, instruments, valves, cold insulation and bypass facilities with regulation functions not described in this invention shall be configured with mature technologies of generally known traditional refrigerating cycles.

Safety and regulation and control facilities associated with the refrigerating cycle apparatus of this invention are provided, so that the apparatus can operate economically and safely with high thermal efficiency, to achieve the goal of energy conservation, consumption reduction and environmental protection.

This invention has been made public with an optimum embodiment as above, however, it is not used to restrict this invention, all variations or decorations made by those familiar with this technology without deviating from the spirit and scope of this invention also falls into the scope of protection of this invention. Therefore, the scope of protection of this invention shall be that defined by the claims in this application.

The invention claimed is:

1. A cascade cold dynamic cycle refrigeration apparatus, comprising a first circuit and a second circuit, wherein the first circuit comprises a refrigerant tank, a first liquid circulating pump, a first cold regenerator, a cold consuming apparatus, and expander that is configured to drive a braking equipment connected thereto, a second cold regenerator, and a first throttle valve, wherein the second circuit comprises the refrigerant tank, a second liquid circulating pump, and the second cold regenerator, wherein the first circuit is configured such that during operation a refrigerant in the refrigerant tank flows sequentially from the refrigerant tank, the first liquid circulating pump, the first cold regenerator, the cold consuming apparatus, the expander, the first cold regenerator, the second cold regenerator, the throttle value, and returns to the refrigerant tank, and wherein the second circuit is configured such that during operation the refrigerant in the refrigerant tank flows sequentially from the refrigerant tank, the second liquid circulating pump, the second cold regenerator, and returns to the refrigerant tank.

2. The cascade cold dynamic cycle refrigeration apparatus of claim 1, wherein the refrigerant is a single-component low boiling point refrigerating medium that has a boiling point below −10° C. under a standard condition, or a mixture comprising the refrigerating medium as a main component.

3. The cascade cold dynamic cycle refrigeration apparatus of claim 2, wherein the second circuit further comprises a second throttle valve disposed between the second cold regenerator and the refrigerant tank, and, during operation, the refrigerant form the second cold regenerator is configured to return to the refrigerant tank via the second throttle valve.

4. The cascade cold dynamic cycle refrigeration apparatus of claim 2, wherein the cold consuming apparatus is selected from the group consisting of a refrigerator, an air conditioner, a refrigerating store, and mixtures thereof.

5. The cascade cold dynamic cycle refrigeration apparatus of claim 2, wherein the braking equipment is a fan, a hydraulic pump, a generator, or a gas compressor.

6. The cascade cold dynamic cycle refrigeration apparatus of claim 2, wherein the first cold regenerator and the second cold regenerator are same or different, each is selected from a group consisting of a tube-shell type cold exchanger, a plate-fin cold exchanger, and a micro channel cold exchanger.

7. The cascade cold dynamic cycle refrigeration apparatus of claim 2, wherein the refrigerant tank is thermally insulated.

* * * * *